United States Patent [19]

Matsuo

[11] 4,338,487

[45] Jul. 6, 1982

[54] CONDENSER BUSHING

[75] Inventor: Junichi Matsuo, Chita, Japan

[73] Assignee: NGK Insulators, Ltd., Nagoya, Japan

[21] Appl. No.: 236,063

[22] Filed: Feb. 19, 1981

[30] Foreign Application Priority Data

Mar. 7, 1980 [JP] Japan ..... 55-29441[U]

[51] Int. Cl.[3] ..... H01B 17/28

[52] U.S. Cl. ..... 174/143; 174/73 R

[58] Field of Search ..... 174/73 R, 73 SC, 143

[56] References Cited

U.S. PATENT DOCUMENTS 1,585,124 5/1926 Simons ..... 174/73 R X

FOREIGN PATENT DOCUMENTS 742448 12/1932 France ..... 174/143

*Primary Examiner*—Laramie E. Askin

*Attorney, Agent, or Firm*—Stevens, Davis, Miller and Mosher

[57] ABSTRACT

A condenser bushing comprising a condenser core formed by winding around a center electrode an insulating paper, an electrically conductive or semi-conductive linear electrode arranged at at least one of the side edge portions of the insulating paper, and a plurality of intermediate electrodes having end portions making contact with the linear electrodes and extending in a widthwise direction of the insulating paper, the intermediate electrodes being inserted between the insulating layers and being spaced apart from each other by a given distance.

4 Claims, 3 Drawing Figures

CONDENSER BUSHING

BACKGROUND OF THE INVENTION

1. Field of the Invention

This invention relates to a condenser bushing comprising a condenser core which is simple in construction and which can uniformly distribute the electric field in the axial direction of the condenser core.

2. Description of the Prior Art

In general, a condenser bushing is composed of a center conductor and a condenser core wound around the center conductor. The condenser core wound around the center conductor is formed by alternatively winding around the center conductor an insulating layer composed of an insulating paper having a large width or a tape-shaped insulating layer and a metal foil or an electrically conductive layer coated with an electrically conductive or semi-conductive paint. In this case, the metal foils or the like for forming the electrically conductive layer, have usually been inserted between the insulating layers and spaced apart from each other by a given distance corresponding to a thickness of 1 mm to 2 mm of the insulating layers. Since the metal foil is manually inserted between the insulating layers, it is impossible to avoid error due to such manual insertion. If the metal foil is displaced in the case of inserting it between the insulating layers, concentration of the electric field at the edge portions of said metal foil occurs, thereby considerably decreasing the electrical insulating ability of the condenser core. In order to avoid this, after the winding operation of the condenser core has been completed, the position of the metal foil must be inspected by X-ray photography. Such inspection is so expensive and troublesome in operation that it cannot be done practically. Therefore, the reliability of the electrical insulation is decreased. In addition, the condenser core winding machine must be stopped every time the metal foil is inserted between the insulating layers for the purpose of checking the inserting position of the metal foil. As a result, if the number of the metal foils to be inserted increases, the productivity of the condenser core is extremely lowered. The higher the voltage of the condenser bushing the longer the condenser core and the larger the thickness thereof, and as a result, the productivity of the condenser core is further lowered.

Many attempts have been made to decrease the number of the metal foils to be inserted between the insulating layers for the purpose of improving the productivity of the condenser core, but hitherto none had led to fully satisfactory results. That is, if the number of the metal foils is reduced, the space between the metal foils becomes large for the electric field to concentrate at the edge portions of the metal foil. As a result, the insulation in the axial direction of the condenser core becomes low, thereby lowering the electric insulating ability of the condenser bushing as a whole.

Heretofore, it has been the common practice to space the metal foils apart from each other by a distance corresponding to a thickness of 1 mm to 2 mm of the insulating layers. Such arrangement of the metal foils results in a frequent stoppage of the core winding machine, thereby lowering the productivity.

Meanwhile, the condenser cores are becoming ever bigger due to the increase of the insulation voltage. The use of such large type condenser core gives rise to various troubles inclusive of the trouble that the core winding operation becomes difficult or the like.

SUMMARY OF THE INVENTION

An object of the invention, therefore, is to provide a condenser bushing which can eliminate the above-mentioned drawbacks which have been encountered with the prior art techniques.

A feature of the invention is the provision of a condenser bushing comprising an insulating paper wound around a center electrode and forming insulating layers of a condenser core, said insulating paper being provided at at least one of its side edge portions extending in a lengthwise direction thereof with an electrically conductive or semiconductive linear electrode and being provided with a plurality of intermediate electrodes having end portions making contact with said linear electrode and extending in a widthwise direction of said insulating paper, said intermediate electrodes being inserted between said insulating layers and being spaced apart from each other by a given distance.

Further objects and features of the invention will be fully understood from the following detailed description with reference to the accompanying drawings, wherein:

DETAILED DESCRIPTION OF THE PREFERRED EMBODIMENTS

Figure 1:
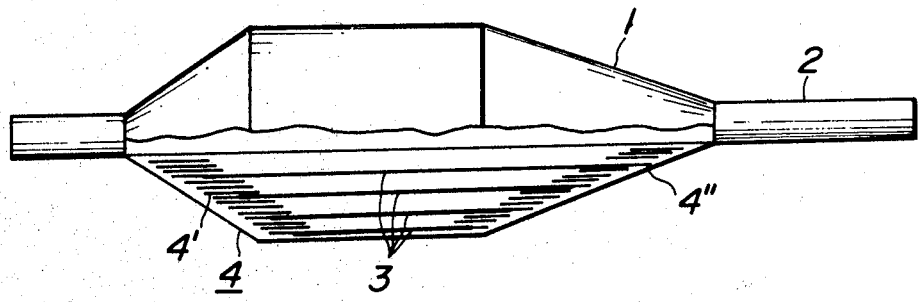
FIG. 1 is a front elevational view of one embodiment of a condenser bushing according to the invention, partly shown in section.
Figure 2:
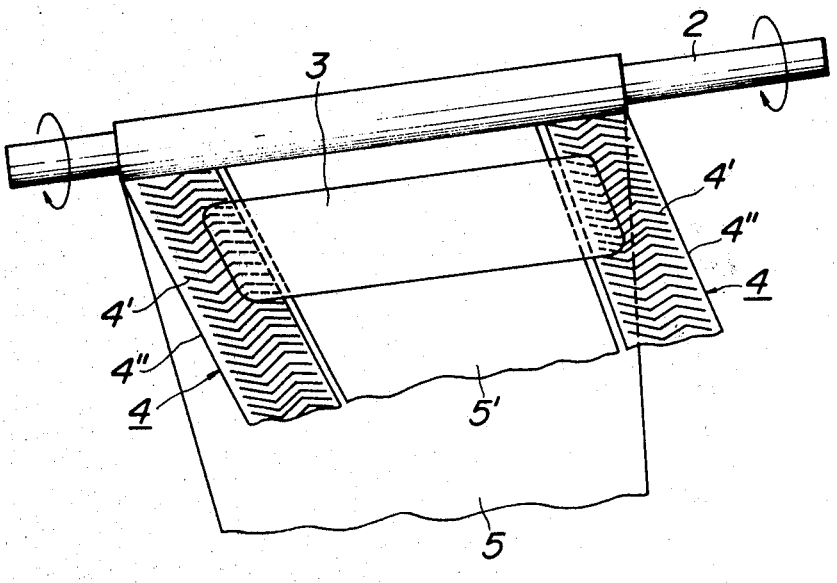
FIG. 2 is an explanatory view illustrating the mode of winding the condenser core shown in FIG. 1.

FIGS. 1 and 2 show one embodiment of a condenser bushing according to the invention. In this embodiment, around a center conductor 2 are simultaneously wound an insulating paper 5, a band-shaped linear electrode 4 composed of a tape-shaped insulating paper 4'' including linear semiconductor electrodes 4' printed beforehand thereon and arranged on both side edges of the insulating paper 5 and an insulating paper 5' arranged between the linear electrodes 4, 4 to form a condenser core 1. In the course of winding the insulating papers 5, 5' and the linear electrodes 4, 4 around the center conductor 2, intermediate electrodes 3 formed of an electrically conductive material which is thin in thickness, light in weight and having an excellent electric conductivity, for example a metal foil, are inserted between the insulating layers such that the intermediate electrodes 3 are spaced apart from each other as shown in FIG. 1 and that both end portions of the intermediate electrodes 3 are overlapped with one portion of the linear electrode 4. The intermediate electrode 3 has a proper configuration and functions to adjust the electric field in a radial direction of the condenser core 1.

The use of the condenser core 1 constructed as above described provides the important advantage that even when the intermediate electrode 3 is displaced by mistake during the winding operation, the potential gradient at the edge portions of the condenser core is not influenced at all by such displacement if the intermediate electrode 3 is in contact with and within the linear electrodes 4, 4, and that it is possible to significantly improve the reliability of the winding operation without lowering the electric insulating ability of the condenser bushing.

In the present embodiment, use was made of the linear semi-conductor electrode 4' composed of herring bone lines for the sake of convenience in printing. Alternatively, the linear semi-conductor electrode 4' may be composed of straight lines with the same effect obtained.

The electrical potential in the axial direction of the condenser core is distributed by the mutual electrostatic capacity between the linear semi-conductor electrodes 4', 4'. As a result, the numer of the intermediate electrodes composed of the metal foil or the like to be inserted between the insulating layers may be considerably reduced by spacing them from each other by a distance corresponding to a thickness of 5 mm, 10 mm, . . . , for example, of the insulating layers without changing the electrical stress distribution in the axial direction of the condenser core and hence without lowering the electric insulating ability of the condenser bushing.

Figure 3:
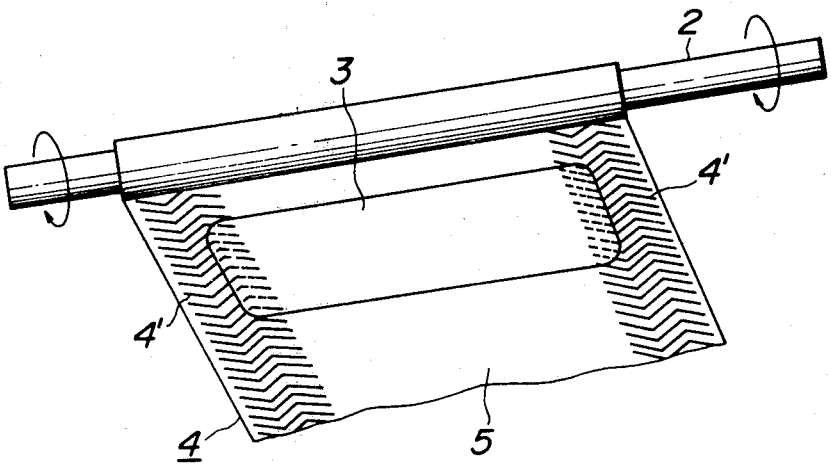
FIG. 3 is an explanatory view illustrating the mode of winding a condenser core of another embodiment of a condenser bushing according to the invention.

FIG. 3 shows another embodiment of a condenser bushing according to the invention. In that embodiment, band-shaped linear electrodes 4, 4 each composed of linear semi-conductor electrodes 4' printed on a tape-shaped insulating paper 4'' are not disposed on both side edges of an insulating paper 5, but the linear semi-conductor electrodes 4' are directly printed on both side edges of the insulating paper 5, thereby making the linear electrodes 4, 4 integral with the insulating paper 5. The use of such construction ensures an omission of necessity of separately inserting the linear electrodes 4, 4 between the insulating layers during the winding operation and provides the important advantage that workability of the condenser core winding can be improved.

In the case of applying the condenser bushing to an air-oil bushing, since the length of the air side of the condenser core 1 is considerably longer than the axial length of the oil side, it is not always necessary to provide the linear electrode 4 at the air side.

As stated hereinbefore, the condenser bushing according to the invention is capable of uniformly distributing the electric field in the axial direction of the condenser core and hence improving the electric insulating ability of the condenser bushing as a whole, of completely eliminating the drawback of degrading the reliability of the core winding operation due to the erroneous insertion of the intermediate electrodes such as metal foils or the like and of significantly reducing the number of the intermediate electrodes to be inserted between the insulating layers and hence simplifying the operation and considerably improving the productivity of the condenser bushing.

What is claimed is:

1. A condenser bushing comprising an insulating paper wound around a center electrode and forming insulating layers of a condenser core, said insulating paper being provided at at least one of its side edge portions extending in a lengthwise direction thereof with an electrically conductive or semi-conductive linear electrode and being provided with a plurality of intermediate electrodes having end portions making contact with said linear electrode and extending in a widthwise direction of said insulating paper, said intermediate electrodes being inserted between said insulating layers and being spaced apart from each other by a given distance.

2. The condenser bushing according to claim 1, wherein said linear electrode is composed of a tape-shaped insulating paper including linear semi-conductor electrodes printed beforehand thereon and arranged at both side edges of said insulating paper wound around said center electrode.

3. The condenser bushing according to claim 1, wherein said linear electrode is composed of linear semi-conductor electrodes directly printed on both side edges of said insulating paper.

4. The condenser bushing according to claim 1, wherein said intermediate electrodes are spaced apart from each other by a distance corresponding to a thickness of 5 mm, 10 mm, . . . of the insulating layers.

* * * * *